US007264779B2

(12) United States Patent
Viot

(10) Patent No.: US 7,264,779 B2
(45) Date of Patent: Sep. 4, 2007

(54) PIPETTE WITH TIP EJECTOR

(75) Inventor: Francois Viot, Auvers-sur-Oise (FR)

(73) Assignee: Gilson S.A.S., Villiers-Le-Bel (FR)

( * ) Notice: Subject to any disclaimer, the term of this patent is extended or adjusted under 35 U.S.C. 154(b) by 284 days.

(21) Appl. No.: 10/240,985

(22) PCT Filed: Apr. 9, 2001

(86) PCT No.: PCT/FR01/01073

§ 371 (c)(1),
(2), (4) Date: Jan. 22, 2003

(87) PCT Pub. No.: WO01/76753

PCT Pub. Date: Oct. 18, 2001

(65) Prior Publication Data

US 2004/0028564 A1 Feb. 12, 2004

(30) Foreign Application Priority Data

Apr. 7, 2000 (FR) ..... 00 04471

(51) Int. Cl.
*B01L 3/02* (2006.01)

(52) U.S. Cl. ..... 422/100; 73/864.01; 73/864.13; 73/864.14

(58) Field of Classification Search ..... 422/100; 73/864.11, 864.14, 864.18
See application file for complete search history.

(56) References Cited

U.S. PATENT DOCUMENTS 2,986,119 A 5/1961 Roesler et al.
3,497,305 A 2/1970 König
3,604,267 A 9/1971 Johns
3,766,785 A 10/1973 Smernoff
3,882,729 A * 5/1975 Roach ..... 73/864.18
3,918,308 A 11/1975 Reed
3,991,617 A * 11/1976 Marteau d'Autry ..... 73/864.14
4,009,611 A * 3/1977 Koffer et al. ..... 73/864.14
4,151,750 A 5/1979 Suovaniemi et al.
4,164,870 A 8/1979 Scordato et al.
4,263,257 A 4/1981 Metsälä
4,268,481 A 5/1981 Suovaniemi et al.
4,283,950 A 8/1981 Tervamäki
4,369,665 A 1/1983 Citrin
4,442,722 A 4/1984 Meyer
RE32,210 E 7/1986 d'Autry (Continued)

FOREIGN PATENT DOCUMENTS

DE 2954504 9/1986

(Continued)

OTHER PUBLICATIONS http://www.allwords.com/word-knurled.html.*

(Continued)

*Primary Examiner*—Jan M. Ludlow
(74) *Attorney, Agent, or Firm*—Foley & Lardner LLP

(57) ABSTRACT

The sampling pipette includes an ejector arm for separating from the pipette a cone that is fixed to the pipette. The pipette includes adjustment means enabling the length of the arm to be varied continuously over a range of values.

20 Claims, 5 Drawing Sheets

U.S. PATENT DOCUMENTS

| | | | | |
|---|---|---|---|---|
| 4,965,050 | A * | 10/1990 | Jessop | 422/100 |
| 5,012,682 | A | 5/1991 | Sabloewski | |
| 5,073,343 | A | 12/1991 | Hukuhara et al. | |
| 5,320,810 | A | 6/1994 | Al-Mahareeq et al. | |
| 5,413,006 | A | 5/1995 | D'Autry | |
| 5,435,197 | A | 7/1995 | Telimaa et al. | |
| 5,614,153 | A | 3/1997 | Homberg | |
| 5,650,124 | A | 7/1997 | Gilson | |
| 5,696,330 | A | 12/1997 | Heinonen | |
| 5,792,424 | A | 8/1998 | Homberg et al. | |
| 5,849,248 | A | 12/1998 | Homberg | |
| 5,879,633 | A | 3/1999 | Tervamäki et al. | |
| 5,958,343 | A | 9/1999 | Astle | |
| 5,983,733 | A | 11/1999 | Strandberg et al. | |
| 6,295,880 | B1 | 10/2001 | Gilson | |
| 6,532,837 | B1 | 3/2003 | Magussen, Jr. et al. | |
| 6,779,412 | B2 | 8/2004 | Viot | |
| 6,833,114 | B1 * | 12/2004 | Christen et al. | 422/100 |
| 2003/0074988 | A1 | 4/2003 | Suovaniemi et al. | |
| 2003/0074989 | A1 | 4/2003 | Magussen, Jr. et al. | |
| 2003/0159525 | A1 | 8/2003 | Viot | |

FOREIGN PATENT DOCUMENTS

| | | | |
|---|---|---|---|
| DE | 4339143 | | 5/1995 |
| EP | 0566939 | | 10/1993 |
| EP | 0704242 | | 4/1996 |
| EP | 1268070 | | 11/2003 |
| EP | 1268067 | | 6/2004 |
| EP | 1268068 | | 8/2004 |
| FR | 1166673 | | 11/1958 |
| FR | 00 04475 | | 12/2002 |
| FR | 0004472 | | 4/2004 |
| GB | 2029723 | | 3/1950 |
| WO | WO93/11870 | | 6/1993 |
| WO | WO96/04991 | | 2/1996 |
| WO | WO 00/69562 | * | 11/2000 |
| WO | WO 01/42759 | | 6/2001 |
| WO | WO 01/76747 | | 10/2001 |
| WO | WO 01/76748 | | 10/2001 |
| WO | WO 01/76749 | | 10/2001 |
| WO | WO 01/76750 | | 10/2001 |
| WO | WO 01/76751 | | 10/2001 |
| WO | WO 01/76752 | | 10/2001 |

OTHER PUBLICATIONS http://www.answers.com/topic/nut?print=true.*
Internet World Wide Web Page, http://www.rainin-global.com/edp-plus, printed Mar. 8, 2004.
Internet World Wide Web Page, http://www.accuratebalance.com/prod03, printed Mar. 8, 2004.

* cited by examiner

PIPETTE WITH TIP EJECTOR

The invention relates to pipettes for taking samples of liquids.

By way of example, document FR-2 696 110 discloses a sampling pipette suitable for receiving a discardable cone at its bottom end that is held on the pipette by friction. The pipette has an ejector that is actuatable by means of a button adjacent to the sampling button. Pressing on that button enables the cone to be pushed away from the pipette when it is desired to change a used cone for a new cone. Nevertheless, a drawback with that pipette is that the ejector is compatible with a single type of cone only. However, it is desirable to be able to use the pipette with cones of different dimensions.

An object of the invention is to provide a pipette in which the ejector is compatible with different types of cones.

In order to achieve this object, the invention may include a sampling pipette comprising an ejector arm for separating from the pipette a cone that is fixed to the pipette, the pipette comprising adjustment means enabling the length of the arm to be varied continuously over a range of values. In an exemplary embodiment, the ejector arm may include an actuator, an ejector rod, and a connector connecting the actuator with the ejector rod, the connector enabling the length of the arm to be varied continuously over a range of values.

The length of the ejector can thus be adjusted as a function of the position on the pipette of the cone in use. The ejector is thus compatible with numerous types of cones.

The invention may also present at least one of the following characteristics:

- the arm comprises two arm portions connected to each other by a screw-and-nut connection;
- the pipette has a nut-forming part that is prevented from sliding relative to one of the arm portions and that is connected by a screw to the other arm portion;
- the nut-forming part is a knurled wheel that is accessible directly from outside the pipette;
- the arm portion slidably fixed relative to the nut-forming part is a bottom arm portion, the other arm portion being a top arm portion; and
- the arm comprises a first portion suitable for coming into contact with the cone and a second portion, the two portions being engaged one in the other, enabling the first portion to be separated from the body starting from an operating position by being moved in a direction that is essentially perpendicular to the longitudinal direction of the pipette.

Other characteristics and advantages of the invention appear further from the following description of a preferred embodiment given by way of non-limiting example. In the accompanying drawings.

The sampling pipette constituting the present embodiment of the invention is of the same type as that disclosed in document FR-2 696 110. Reference can thus be made to that document for certain details of the pipette already disclosed in that document. Only certain aspects of the cone-ejector mechanism are described in detail herein.

Figure 2:
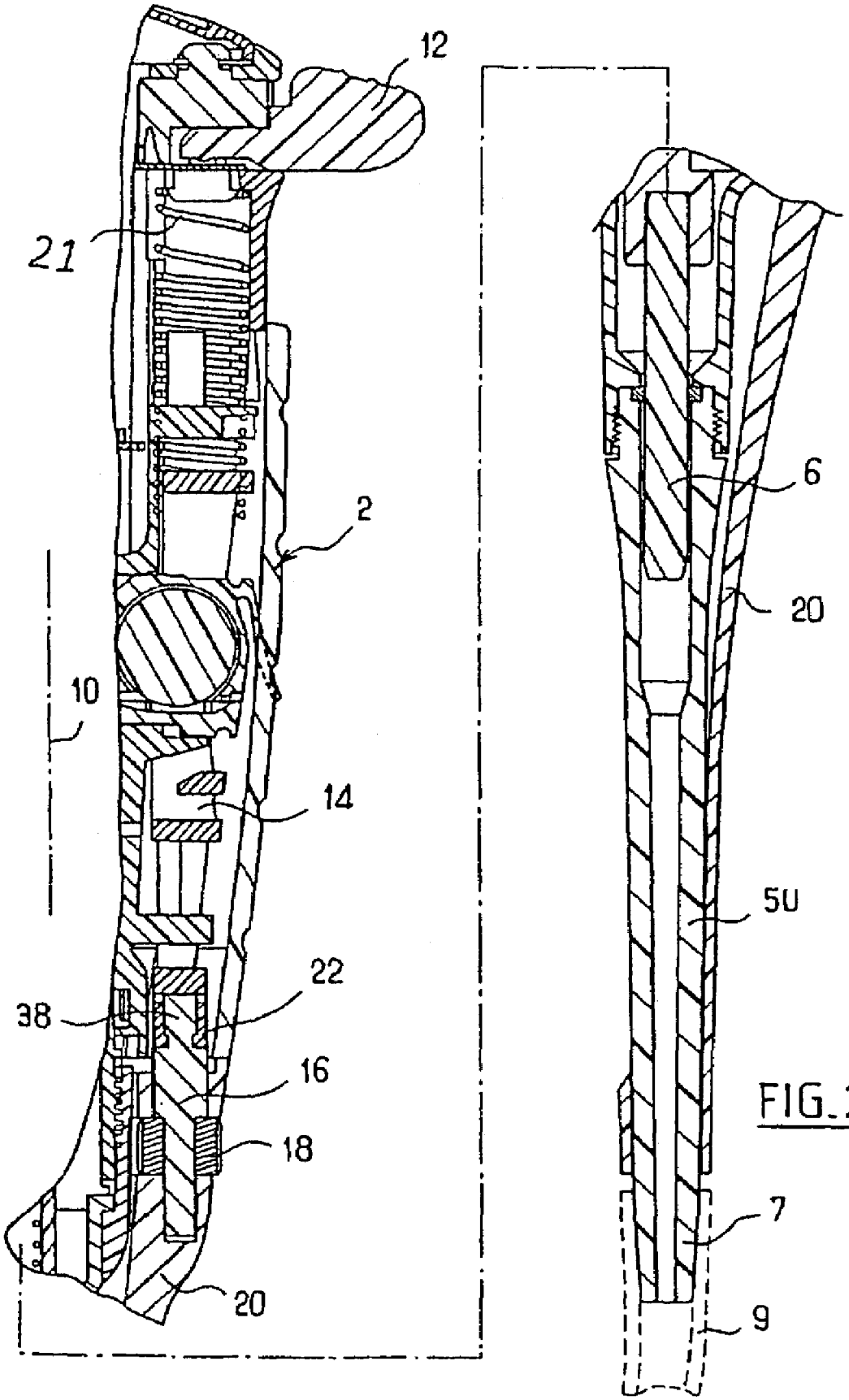
FIG. 2 is a fragmentary axial section view of the pipette showing how the FIG. 1 mechanism is located.
Figure 3:
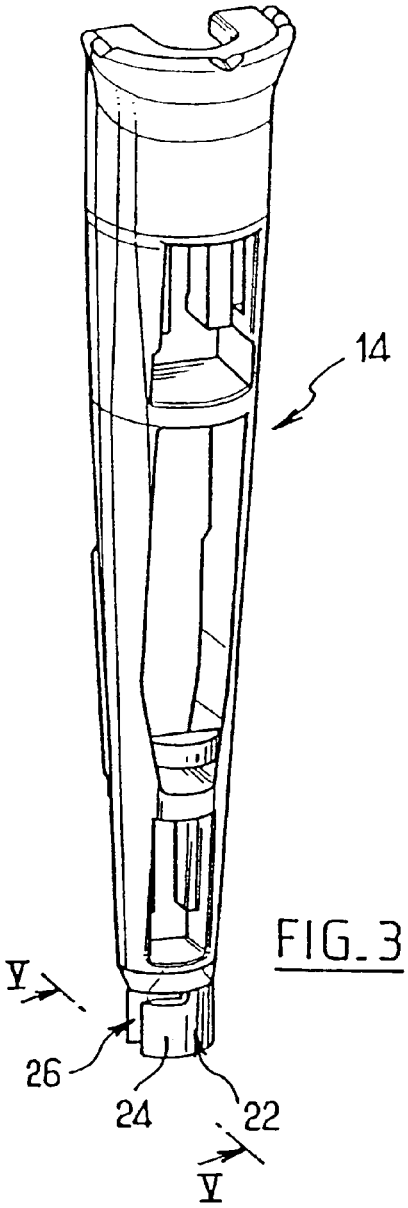
FIGS. 3 and 4 are two perspective views of the actuator of the FIG. 1 mechanism.
Figure 4:
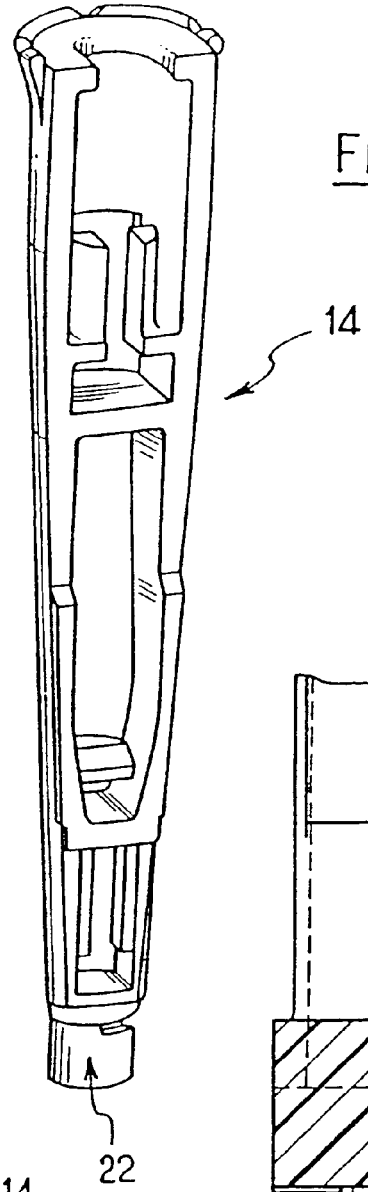

With reference to FIG. 2, the pipette conventionally comprises a body 2 serving as a handle to be held in the hand of the user. The pipette has a piston 6 that is slidably movable along a longitudinal axis 10 of the pipette in a bottom cavity of the pipette in order to suck a volume of liquid to be sampled into the pipette or to expel it from said cavity. The movement of the piston 6 is controlled in particular by means of a control rod on the longitudinal axis 10 connected at its bottom end to the piston 6 by parts of conventional type. The control rod is surmounted at its top end by a pushbutton rigidly fixed to the control rod and suitable for being actuated by the user using the thumb of the hand that is holding the pipette. The piston 6 thus moves down and up as a function of the corresponding movement of the pushbutton. The pipette has a return spring suitable for returning the piston 6 and the control rod into a high position at the end of their downward stroke for expelling liquid, and a purge spring that adds its effect to that of the return spring when the stroke of the piston 6 is continued downwards for a purge stroke.

The pipette has a bottom clip 7 suitable for receiving in conventional manner a disposable sampling cone 9 which is held to the outside of the bottom clip 7 by friction.

Figure 1:
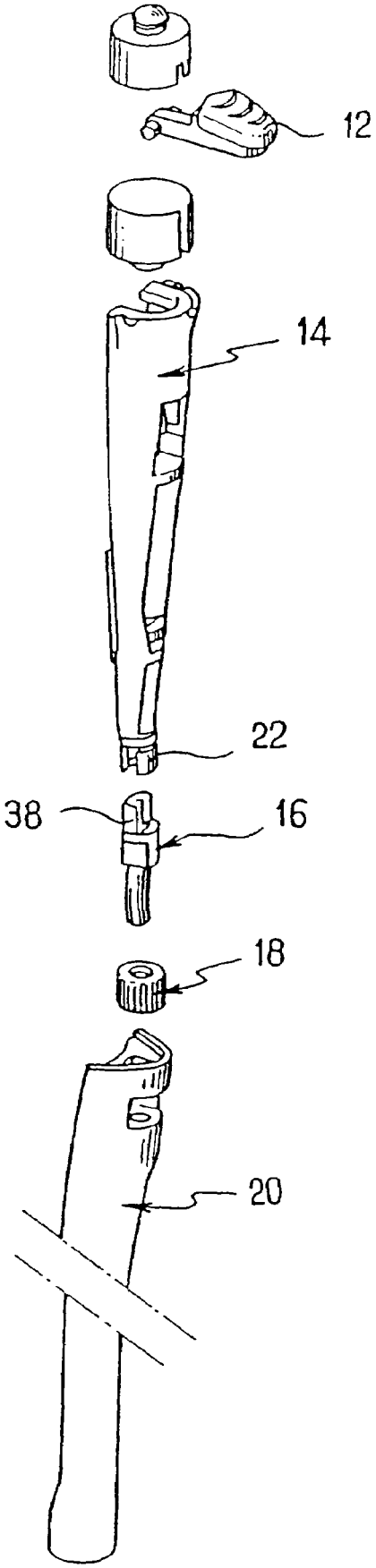
FIG. 1 is a perspective view of the ejector mechanism of a pipette constituting a preferred embodiment of the invention.

The pipette has a cone-ejector mechanism as shown in FIGS. 1 and 2. Going from top to bottom in the longitudinal direction of the pipette, this mechanism comprises a control button 12, an actuator 14, a connection screw 16, a knurled wheel 18 and an ejector rod 20. The FIG. 1 ejector mechanism extends over the rear portion of the pipette, i.e. the portion which is adjacent to the palm of the user's hand.

The actuator 14 is generally elongate in shape and it tapers going downwards. It is housed in the body 2 of the pipette being slidably movable therein along the longitudinal axis 10. The pipette is arranged in such a manner that downward pressure on the control button 12 causes the actuator 14 to move downwards. The connection between the control button 12 and the actuator 14 can be of conventional type and is not described herein. A return spring 21, shown in FIG. 2, serves to raise the actuator 14 when the control button 12 is released.

With reference to FIGS. 3, 4, 5, and 5A, the actuator 14 presents a bottom end constituted by a female coupling portion 22. This portion constitutes a section member extending parallel to the longitudinal axis 10 and has a cross-section that is generally U-shaped, and more precisely it is in the form of a portion of an ellipse with the two limbs 24 of the U-shape coming closer together towards each of their two ends. The opening 26 of the U-shape faces sideways, and in this case towards the left-hand side of the pipette. The bottom edge of the female coupling portion 22 has a shoulder forming a step 28 that extends radially towards the inside of the U-shape. Nevertheless, this step 28 is also U-shaped. Each limb 24 is separated from the remainder of the actuator 14 by a horizontal notch 30 extending from a point situated about halfway along the limb 24 to its free end. The female coupling portion 22 forms a cavity 32 between the limbs 24.

With reference to FIGS. 6 to 9, the connection screw 16 comprises a top head 34. The top head 34 has a support 36 that is generally in the form of a rectangular parallelogram and a male coupling portion 38 suitable for penetrating into the female coupling portion 22 of the actuator. For this purpose, the male coupling portion 38 constitutes a section member extending parallel to the longitudinal axis 10, and its cross-section transverse to said longitudinal axis 10 is generally elliptical in shape. The connection screw 16 has a core 40 from which the support 36 extends upwards, being offset laterally relative to the core 40. The male coupling portion 38 is shorter than the support 36. The top ends of the male coupling portion 38 and of the support 36 are at the same level but the male coupling portion 38 extends at a distance from the core 40 so as to allow the step 28 described with reference to FIGS. 5 and 5A to pass between them. The male coupling portion 38 extends to the right projecting from the support 36, and likewise it extends forwards and to the rear. In left-hand and right-hand view its profile is T-shaped.

The male coupling portion 38 is suitable for being received by engagement in the female coupling portion 22, described with reference to FIGS. 3-5 and 5A, by being moved laterally perpendicularly to the longitudinal axis 10. While insertion is taking place, the limbs 24, described with reference to FIGS. 3, 5 and 5A, spread apart and then move back towards each other, thus generating a click indicting that the male coupling portion 38 has reached a reception position. The limbs 24 are made bendable by the horizontal notches 30 described with reference to FIG. 5 and by the material used which in this case is a thermoplastic. The step 28 described with reference to FIGS. 5 and 5A occupies a position between the male coupling portion 38 and the core 40. The connection screw 16 is thus rigidly secured to the actuator 14. This connection can be disassembled. Assembly and disassembly are performed by moving the connection screw 16 in translation relative to the actuator in a left-right lateral direction.

The core 40 of the connection screw 16 has a flat top plate 42 and a thin bottom portion 44 of essentially rectangular profile. It is extended at its bottom end by a threaded shank 46.

Figure 10:
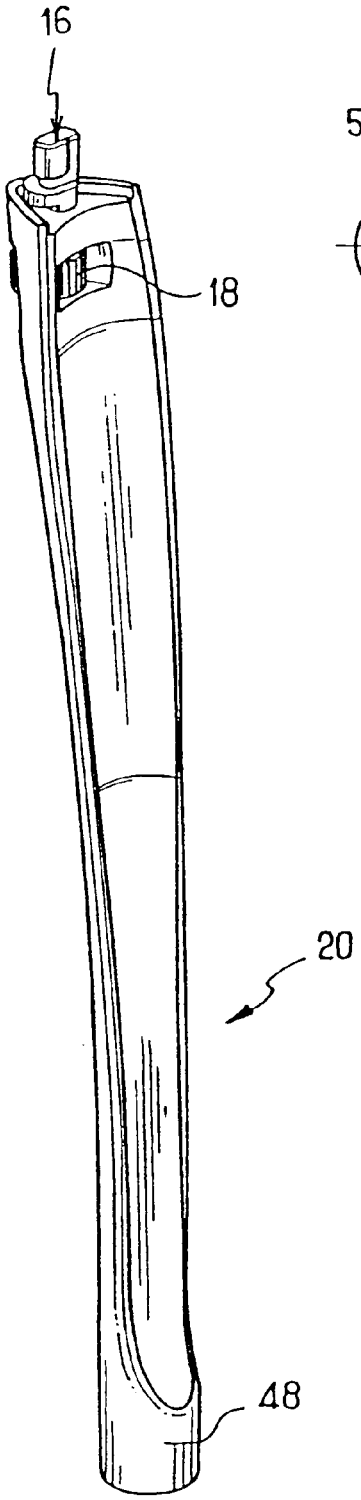
FIGS. 10 and 11 are a perspective view and an axial section view of the ejector rod of the FIG. 1 mechanism.
Figure 12:
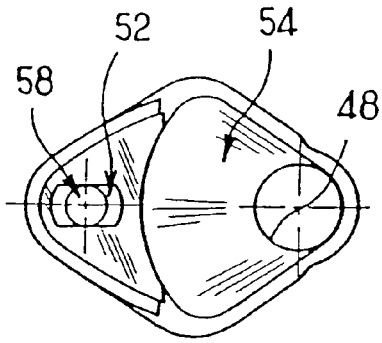
FIG. 12 is a plan view of the FIG. 10 ejector rod.
Figure 11:
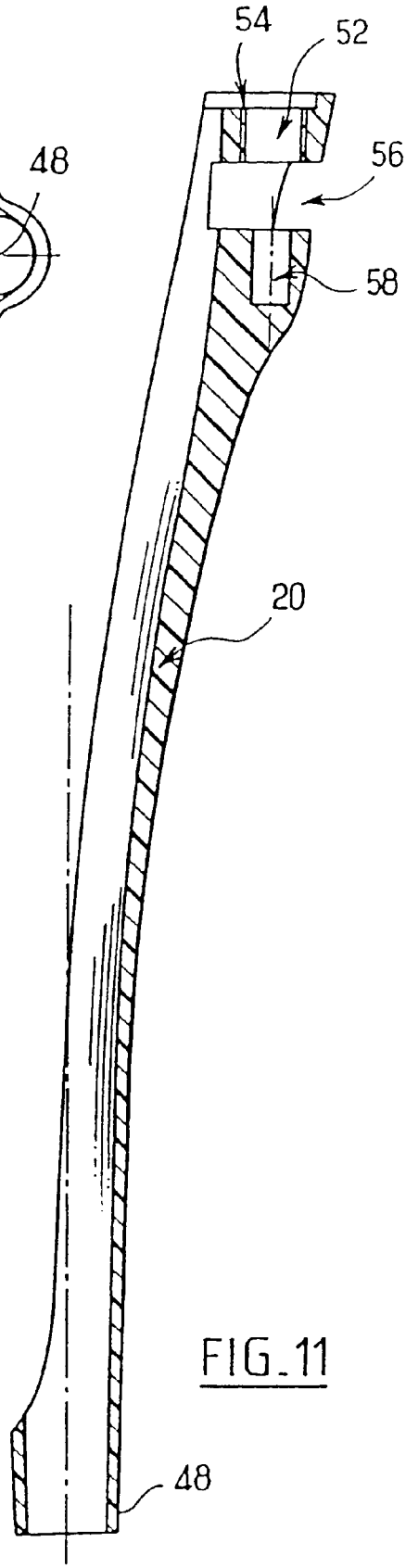

With reference to FIGS. 10 to 12, the ejector rod 20 is elongate in the vertical direction. Its transverse profile is essentially hollow and open. Nevertheless, this profile is closed at the bottom end of the ejector rod 20 so as to form a ring 48 that is slidably engaged on a bottom endpiece 50 of the body 2 forming the bottom clip 7, as shown in FIG. 2. This ring 48 is suitable for coming into direct contact with the sampling cone in order to eject it. Furthermore, the ejector rod 20 is essentially non-rectangular in shape so as to establish a junction between said bottom endpiece lying on the longitudinal axis 10 of the pipette and the rear portion of the pipette at the top end of the ejector rod 20 which is off-center relative to the longitudinal axis 10.

At its top end, the ejector rod 20 presents a top vertical duct 52 of rectangular cross-section extending from a top face 54 of the ejector rod 20 to a notch 56 extending horizontally into the ejector rod 20 from its rear face towards its front face. Beneath the notch 56, the ejector rod 20 presents a bottom duct 58 axially in line with the top vertical duct 52, but this time of circular cross-section. The diameter of the bottom duct 58 is equal to the width of the section of the top vertical duct 52. Likewise, as described with reference to FIGS. 6 and 7, the diameter of the threaded shank 46 of the screw 16 is equal to the width of the thin bottom portion 44 of the support 36.

Figure 6:
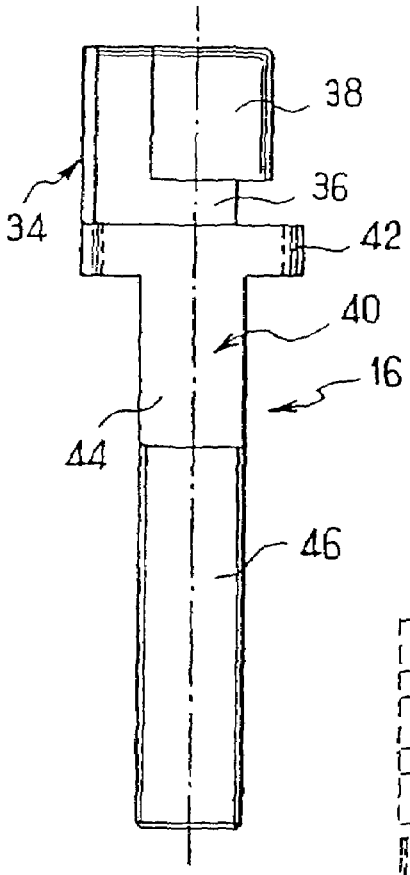
FIGS. 6 and 7 are a rear view and a left-hand view of the connection screw of the FIG. 1 mechanism.
Figure 7:
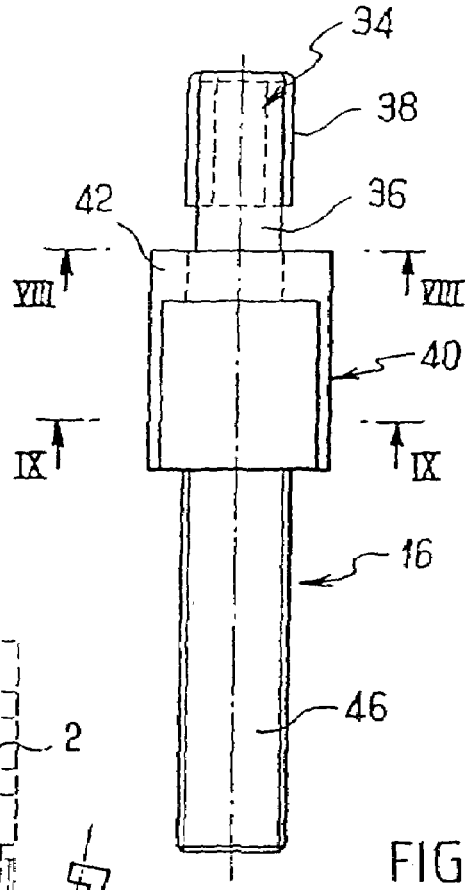

The knurled wheel 18 has a central thread bore for forming a screw-and-nut connection with the shank 46 of the connection screw 16 described with reference to FIGS. 6 and 7.

The knurled wheel 18 is received in the notch 56 on the same axis as the top vertical duct 52 and bottom duct 58. The connection screw 16 penetrates through both ducts and through the knurled wheel 18. The male coupling portion 38 described with reference to FIGS. 6-8 projects from the top face 54. The thin bottom portion 44 of the connection screw support can be housed in the top vertical duct 52 to prevent the ejector rod 20 from rotating relative to the connection screw while allowing them to slide relative to each other. The knurled wheel 18 forms a screw-and-nut connection with the threaded shank of the connection screw. The bottom portion of the screw shank is slidably received in the bottom duct 58. The ejector rod 20 is thus connected to the pipette firstly by the connection screw 16 and secondly by the ring 48 engaged on the bottom endpiece.

The knurled wheel 18 is directly accessible to the user from the rear side of the pipette through the notch 56. Turning the knurled wheel 18 causes the ejector rod 20 to slide up or down relative to the body 2 and parallel to the longitudinal axis 10 so as to adjust its position as a function of the type of disposable sampling cone used.

To eject the cone, the control button 12 described with reference to FIGS. 1 and 2 is lowered until the ejector rod 20 is at the bottom end of its stroke, thereby pushing the cone downwards and detaching it from the pipette.

When the ejector mechanism is at rest, i.e. at the top end of its stroke, the male and female coupling portions 38 and 22 are housed in the body 2 of the pipette where they are inaccessible to the user. Furthermore, they are protected therein against shocks and dirt. The ejector rod 20 cannot be removed in this position.

Figure 13:
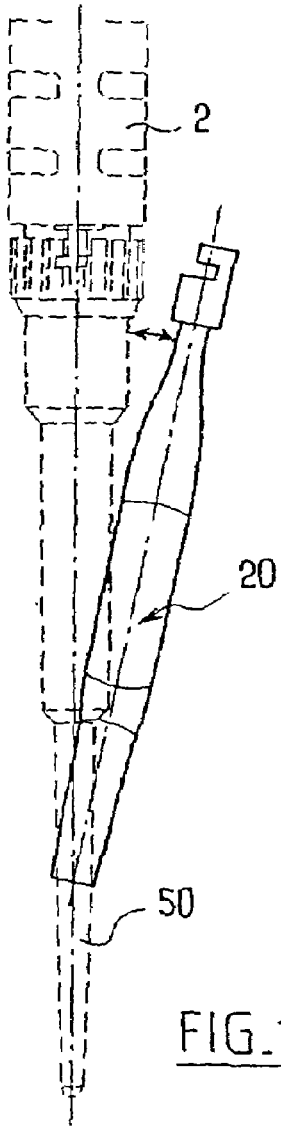
FIG. 13 is a diagram showing how the ejector rod is put into place on the pipette.
Figure 8:
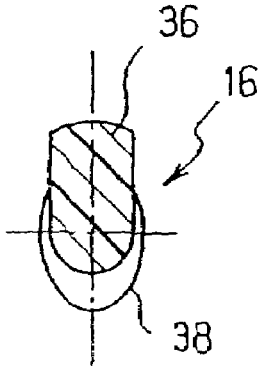
FIGS. 8 and 9 are two cross-section views of the FIG. 7 on planes VIII-VIII and IX-IX.
Figure 9:
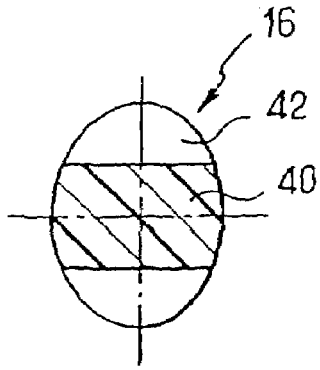

To remove the ejector rod 20 and separate it from the pipette, the control button 12 is lowered so as to place the ejector rod 20 at the bottom end of its stroke. The male and female coupling portions are then visible. The ejector rod 20 is then moved sideways to separate the male and female coupling portions as described above and as shown in FIG. 13. This causes the ejector rod 20 to be tilted relative to the body of the pipette, with such tilting being made possible by clearance at the ring 48. Thereafter, the bottom portion of the ejector rod 20 is caused to slide downwards so as to be disengaged from the pipette. Reassembly is performed by following the operations in reverse order. The ejector rod 20 can be installed and removed without effort, unlike the longitudinal friction connection known in the prior art.

It can thus be seen that the ejector rod 20, the knurled wheel 18, and the connection screw 16 constitute a first portion of the ejector arm that is suitable for being engaged laterally in the second portion of the arm as constituted by the actuator.

It should be observed that the ejector rod can be disassembled in this embodiment by turning the knurled wheel until it becomes disengaged from the connection screw 16. However that would separate the ejector rod 20, the connection screw 16, and the knurled wheel 18 from one another, whereas the procedure as described above keeps these three parts connected together.

Figure 5A:
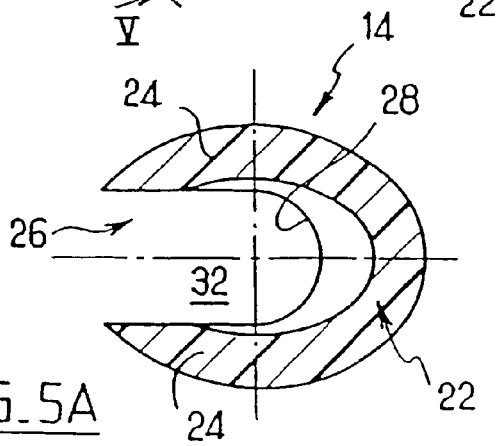
FIG. 5A is an axial section view of the FIG. 5 actuator on plane A-A.
Figure 5:
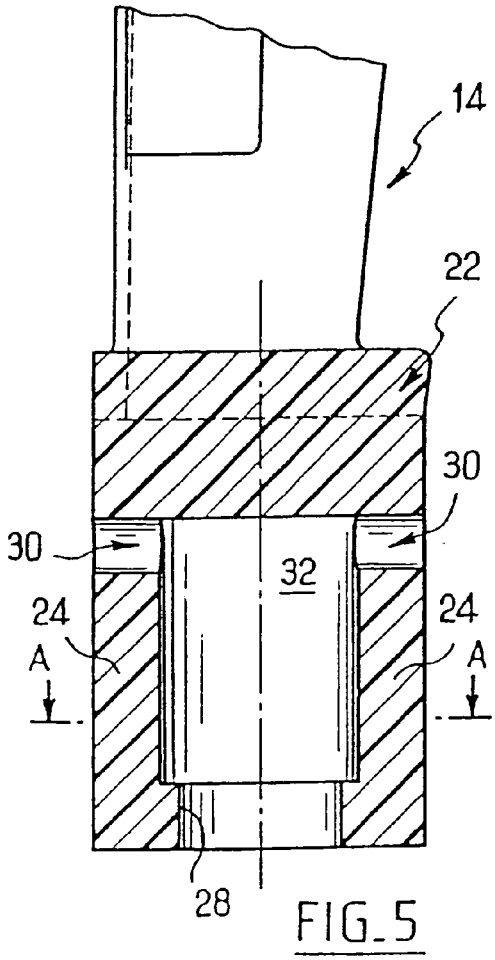
FIG. 5 is a fragmentary axial section view of the FIG. 3 actuator on plane V-V.

Because of the step 28 described with reference to FIGS. 5 and 5A, the ejector rod 20 cannot be separated from the actuator 14 by sliding parallel to the longitudinal axis 10. It is necessary to begin by separating them using relative lateral movement. There is therefore no fear of untimely separation occurring while ejecting a cone.

The knurled wheel 18 serves to adjust the length of the ejector arm constituted by the actuator 14 and the ejector rod 20, over a continuous range of length values.

Naturally, numerous modifications can be applied to the invention without going beyond the ambit thereof.

For example, the ejector rod 20 could be connected to the actuator 14 using other types of connections that form an obstacle to relative sliding between the parts of the ejector, e.g. one or more screw-and-nut connections or a bayonet connection.

The characteristics concerning adjustment of arm length over a continuous range of values can be implemented independently of the characteristics concerning the two arm portions that are engaged one in the other so as to be separable in a direction perpendicular to the longitudinal direction.

The invention claimed is:

1. An ejection mechanism for a sampling pipette, the ejection mechanism comprising:

an actuator mounted to a body of a sampling pipette;

a connector, the connector comprising a head capable of coupling with the actuator; and a shank extending from the head;

a nut including a bore capable of receiving the shank; and an ejector rod, the ejector rod comprising a first end capable of separating from the sampling pipette a cone that is positioned on the pipette; and a second end opposite the first end, wherein the second end comprises a first duct extending from a first surface, the first duct capable of receiving at least a portion of the head;

a second duct extending from a second surface, the second duct capable of receiving at least a portion of the shank; and a notch in the ejector rod disposed between the first duct and the second duct, the notch capable of receiving the nut.

2. The ejection mechanism of claim 1, wherein the head has a generally rectangular cross section.

3. The ejection mechanism of claim 2, wherein the first duct forms a generally rectangular cross section in the first surface.

4. The ejection mechanism of claim 1, wherein the second duct forms a generally circular cross section in the second surface.

5. The ejection mechanism of claim 1, wherein the nut is a knurled wheel.

6. The ejection mechanism of claim 1, wherein the nut is accessible from an exterior of the sampling pipette.

7. The ejection mechanism of claim 1, wherein the shank is at least partially threaded.

8. The ejection mechanism of claim 7, wherein the bore is threaded for receiving the threaded shank.

9. The ejection mechanism of claim 1, wherein the head removably couples with the actuator.

10. The ejection mechanism of claim 1, wherein the head comprises a top plate and a bottom portion extending between the top plate and the shank, wherein the bottom portion has a different cross section than the top plate.

11. The ejection mechanism of claim 10, wherein the first duct is capable of receiving at least a portion of the bottom portion of the head.

12. The ejection mechanism of claim 1, wherein the nut is capable of rotation about an axis generally parallel to the longitudinal axis of the body of the sampling pipette thereby causing adjustment of a position of the first end of the ejector rod relative to the body.

13. A sampling pipette, the sampling pipette comprising:

a sampling tube;

a piston assembly, the piston assembly comprising a piston rod that fits within the sampling tube;

a piston drive mechanism, the piston drive mechanism comprising a control rod that contacts the piston assembly thereby moving the piston rod within the sampling tube and causing regulation of a liquid in the sampling tube;

a body including an end for receiving a sampling cone, wherein the sampling tube, the piston assembly, and the piston drive mechanism mount within the body; and an ejection mechanism, the ejection mechanism comprising an actuator mounted to the body;

a connector, the connector comprising a head capable of coupling with the actuator; and a shank extending from the head;

a nut including a bore capable of receiving the shank; and an ejector rod, the ejector rod comprising a first end capable of separating the received sampling cone from the body; and a second end opposite the first end, wherein the second end comprises a first duct extending from a first surface, the first duct capable of receiving at least a portion of the head;

a second duct extending from a second surface, the second duct capable of receiving at least a portion of the shank; and a notch in the ejector rod disposed between the first duct and the second duct, the notch capable of receiving the nut.

14. The sampling pipette of claim 13, wherein the head has a generally rectangular cross section.

15. The sampling pipette of claim 14, wherein the first duct forms a generally rectangular cross section in the first surface.

16. The sampling pipette of claim 13, wherein the second duct forms a generally circular cross section in the second surface.

17. The sampling pipette of claim 13, wherein the nut is a knurled wheel.

18. The sampling pipette of claim 13, wherein the head removably couples with the actuator.

19. The sampling pipette of claim 13, wherein the head comprises a top plate and a bottom portion extending between the top plate and the shank, wherein the bottom portion has a different cross section than the top plate.

20. The sampling pipette of claim 19, wherein the first duct is capable of receiving at least a portion of the bottom portion of the head.

* * * * *